US005275070A

United States Patent [19]

St. Denis

[11] Patent Number: 5,275,070

[45] Date of Patent: Jan. 4, 1994

[54] DEVICE FOR REMOVING WINE BOTTLE STOPPER

[76] Inventor: Andrew R. St. Denis, 5331 5th Concession, Amherstburg, Ontario, Canada, N9V 2Y9

[21] Appl. No.: 46,816

[22] Filed: Apr. 16, 1993

[51] Int. Cl.[5] ..... B67B 7/02

[52] U.S. Cl. ..... 81/3.29; 81/3.37; 81/3.44

[58] Field of Search ..... 81/3.29, 3.36, 3.4, 81/3.07, 3.44, 3.37

[56] References Cited

U.S. PATENT DOCUMENTS

| | | | |
|---|---|---|---|
| 2,732,741 | 1/1956 | Muller-Strobel | 81/3.41 |
| 2,761,338 | 9/1956 | Hardy | 81/3.38 |
| 4,442,735 | 4/1984 | Chance et al. | 81/3.44 |
| 4,606,245 | 8/1986 | Veverka | 81/3.36 |
| 4,708,033 | 11/1987 | Eash et al. | 81/3.37 |
| 4,756,214 | 7/1988 | Valtri et al. | 81/3.4 |
| 5,000,063 | 3/1991 | Federighi | 81/3.37 |

*Primary Examiner*—Roscoe V. Parker

[57] ABSTRACT

A device is described for removing a mushroom-shape stopper from a wine bottle. It includes: (a) a support frame having a bottom ring member adapted to engage the neck of a wine bottle, a top cap member with a threaded hole extending therethrough and at least two circumferentially spaced longitudinal rods extending between the top cap and bottom ring, (b) a threaded shaft having an upper end and a lower end mounted in the top cap threaded hole, this shaft having a handle mounted on the upper end thereof, and (c) a stopper gripping and pulling member comprising a bridge member connected to the lower end of the threaded shaft such that the threaded shaft is free to rotate relative to the bridge member while being fixed against relative axial movement, guideways in the bridge member for receiving the support frame longitudinal rods thereby preventing rotation of the bridge member, a pair of opposed stopper gripping arms extending downwardly from the bridge member, these gripping arms having at the lower ends thereof inwardly extending gripper dogs adapted to slide downwardly over a mushroom-style stopper and grip the stopper for pulling and these gripper arms being further adapted to swing outwardly from the bridge member to release a pulled stopper.

4 Claims, 3 Drawing Sheets

DEVICE FOR REMOVING WINE BOTTLE STOPPER

BACKGROUND OF THE INVENTION

This invention relates to a device for removing a stopper from a bottle, and more particularly, for removing a mushroom-shaped stopper from a wine bottle.

It is now commonplace to use a form of plastic stopper for wine bottles, particularly sparkling wine or champagne bottles. These plastic stoppers have the advantage of being very inexpensive, but they do present problems that are avoided with traditional bottle corks. Thus, when removing traditional corks, a cork screw is turned into the cork for pulling and this not only provides a pulling means but also a means for controlling the cork from flying when released from the bottle. It is not possible to use a cork screw with a plastic stopper and, therefore, these stoppers are formed with a bulbous head as a means for grasping the stopper for pulling. Because this is not a very efficient means for pulling, it is commonplace to form the stopper with a relatively loose fit in the bottle and provide a wire cage over the bulbous head to hold the stopper from accidentally releasing due to pressure in the bottle. This pressure may be as high as 40 psi. Also, when the plastic stopper is released it frequently becomes a dangerous projectile with the release of gas pressure in the bottle and has caused serious eye injuries. Because the plastic stopper is a dangerous projectile, some wine makers for safety reasons actually use much more expensive mushroom-shaped stoppers formed from cork. A cork stopper inflicts much less damage as a projectile than does a plastic stopper.

There is still a need for a very simple and inexpensive device which is very easy to use and which is capable of removing a plastic bottle stopper without allowing the stopper to become a projectile. To be commercially viable, the device must also be very easy to use, while being formed from a bare minimum of plastic parts.

Numerous devices have heretofore been proposed for removing stoppers from bottles. A particularly significant design is that shown in U.S. Pat. No. 4,756,214 which issued Jul. 12, 1988. The device of this patent goes a long way to meeting the above criteria in terms of safety but it remains a relatively complicated device including a slidable collar to permit engagement with the mouth of the bottle.

An example of the use of a wire cage to prevent accidental release of a stopper is shown in U.S. Pat. No. 4,708,033. Because a stopper will sometimes pop out by itself when the wire cage is removed, it is important that the stopper pulling device be designed such that the wire cage can be loosened after the pulling device has been placed on the bottle.

It is the object of the present invention to provide a stopper pulling device particularly for wine bottles which will not only be convenient and safe to use, but also be simple and very inexpensive to manufacture thereby making it readily accessible to all wine consumers.

SUMMARY OF THE INVENTION

The present invention relates to a device for removing a mushroom-style stopper from a wine bottle. It includes: (a) a support frame having a bottom ring member adapted to engage the neck of a wine bottle, a top cap member with a threaded hole extending therethrough and at least two circumferentially spaced longitudinal rods extending between the top cap and bottom ring, (b) a threaded shaft having an upper end and a lower end mounted in the top cap threaded hole, this shaft having a handle mounted on the upper end thereof, and (c) a stopper gripping and pulling member comprising a bridge member connected to the lower end of the threaded shaft such that the threaded shaft is free to rotate relative to the bridge member while being fixed against relative axial movement, guideways in the bridge member for receiving the support frame longitudinal rods thereby preventing rotation of the bridge member, a pair of opposed stopper gripping arms extending downwardly from the bridge member, these gripping arms having at the lower ends thereof inwardly extending gripper dogs adapted to slide downwardly over a mushroom-shaped stopper and grip the stopper for pulling and these gripper arms being further adapted to swing outwardly from the bridge member to release a pulled stopper.

According to a preferred feature, a disc member is attached to the lower end of the threaded shaft and this disc member has an axially upwardly extending collar which is received in a hole in the bridge member, thereby permitting rotation of the shaft relative to the bridge member. Alternatively, the lower end of the threaded shaft may comprise a slotted collar with outwardly projecting dogs at the bottom, which snaps into the hole in the bridge member for rotation therein, with the projecting dogs retaining the bridge member against axial movement.

The bridge member is also preferably provided with lines of weakness forming self-hinges permitting the gripper arms to swing outwardly and release a pulled stopper.

All parts of the device of this invention can be conveniently made from a variety of injection mouldable plastic materials, but a strong plastic such as DERLIN ® is preferred.

BRIEF DESCRIPTION OF THE DRAWINGS

In the drawings which illustrate the present invention.

DESCRIPTION OF PREFERRED EMBODIMENTS

Figure 1:
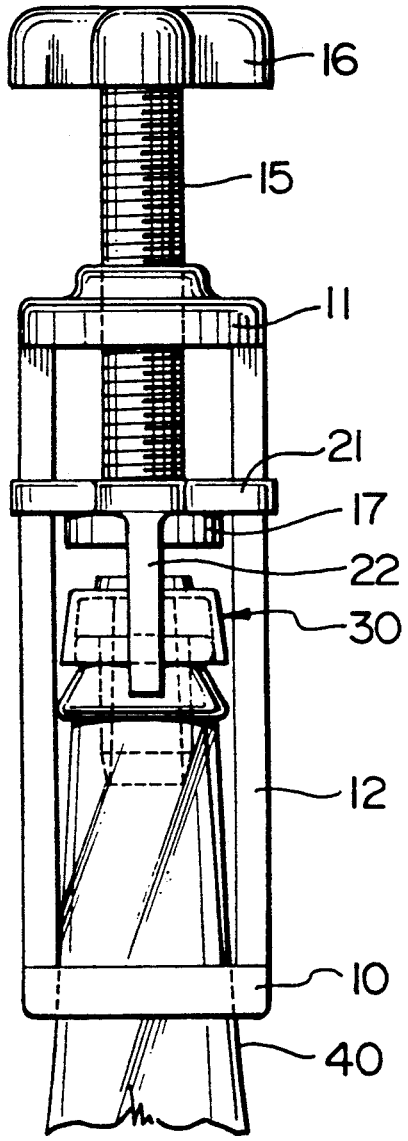
FIGS. 1, 2 and 3 are side elevational views of the device of the invention.
Figure 2:
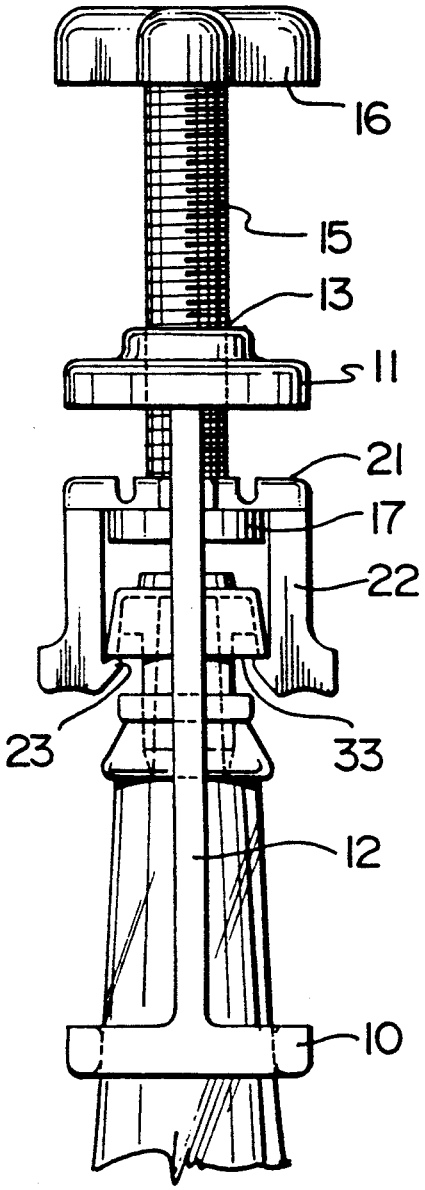

The device of this invention is primarily of use for pulling bulbous or mushroom-shaped stoppers 30 of the type typically found in champagne and sparkling wine bottles. These stoppers 30 are typically made of plastic materials and have a cylindrical stopper portion 31 for inserting into a wine bottle mouth and a bulbous top portion 32. A shoulder 33 is formed between the top portion 32 and stopper 31.

Figure 6:
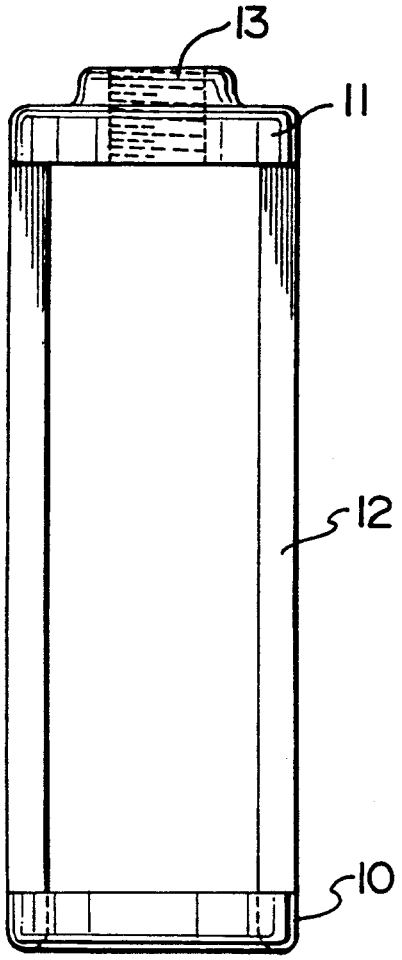
FIG. 6 is a side elevational view of a frame portion.
Figure 7:
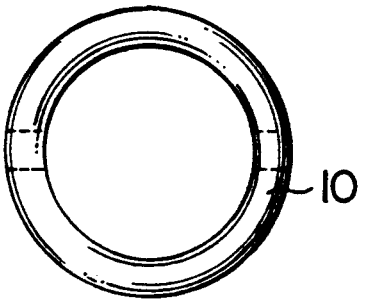
FIG. 7 is a bottom end view of the component of FIG. 6.

There are three main components to the device of the invention, these being (1) a support frame, (2) a threaded shaft with handle and (3) a stopper gripping and pulling member. The support frame includes a bottom ring member 10 adapted to slide down onto and engage a wine bottle neck 40. The frame also includes a top cap member 11 with a threaded hole 13 extending therethrough. The ring 10 and cap 11 are joined by means of two diametrically opposed rod members 12. The structure of this support frame can best be seen from FIGS. 6 and 7.

A threaded shaft 15 extends downwardly through the threaded hole 13 in top cap 11. A handle 16 is affixed to the top end of shaft 15 while the lower end of the shaft is rotatably connected to the stopper gripping and pulling member 20.

Figure 5:
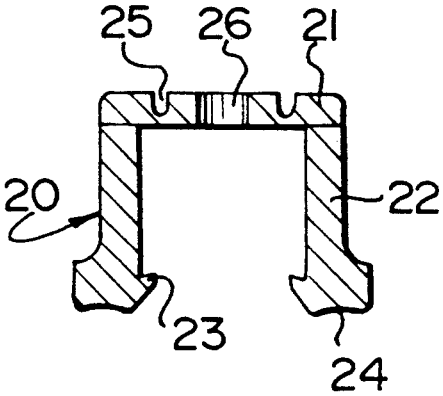
FIG. 5 is a side elevational view in section of a gripping unit.
Figure 8:
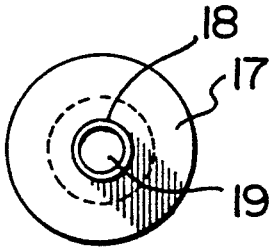
FIG. 8 is a bottom view of a mounting disc.
Figure 9:
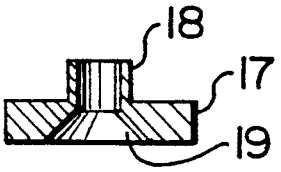
FIG. 9 is a side elevational view of the disc of FIG. 8.

The stopper gripping and pulling member 20 (referred to hereinafter as the gripper) can be seen in detail in FIG. 5 and it includes a top or bridge member 21 with gripper arms 22 extending downwardly therefrom. The gripper arms 22 have inwardly extending gripping dogs 23 and the bottom ends of the gripping arms have concave faces 24. The top or bridge portion 21 has a central hole 26 for mounting to the bottom end of threaded shaft 15. This mounting is achieved by means of a mounting disc 17 as shown in FIGS. 8 and 9. This disc 17 includes an upwardly extending annular shoulder portion 18 which fits into hole 26 in bridge portion 21 of gripper 20 and serves as a pivot. The disc 17 also includes a hole 19 for inserting a threaded screw which serves to fix the disc 17 to the bottom end of threaded shaft 15. In this manner, the threaded shaft is free to turn relative to the gripper 20 by means of the collar 18, while the disc portion 17 prevents axial movement between the shaft 15 and gripper 20.

The gripper 20 also includes in the bridge portion 21 guideways 27 which receive the rods 12 of the frame assembly. Thus, the gripper slides upwardly and downwardly within the frame assembly and is prevented by rotation by engagement between the guideways 27 and the rods 12.

The bridge portion 21 of the gripper 20 is also preferably provided with grooves or lines of weakness 25 which form self hinges of the portions attached to the gripper arms 22, the purpose of which will be explained hereinafter.

In operation, the handle 16 is rotated to move the gripper 20 to an upper position within the frame and the frame is then placed over the end of a wine bottle and allowed to slide downwardly on the neck until the bottom ring 10 of the frame firmly engages the neck 40. The handle 16 is then turned causing the gripper 20 to move downwardly until the gripper teeth 23 have snapped below the shoulder portion 33 of the stopper 30.

The handle 16 is then rotated causing the gripper 20 to move upwardly and pulling the stopper 30 from the bottle. The stopper eventually releases from the bottle with a pop, but is prevented from flying because it is firmly held within the gripper arms 22 and the rods 12. Thus, it can move upwardly only the short distance until it abuts against the disc member 17.

Figure 3:
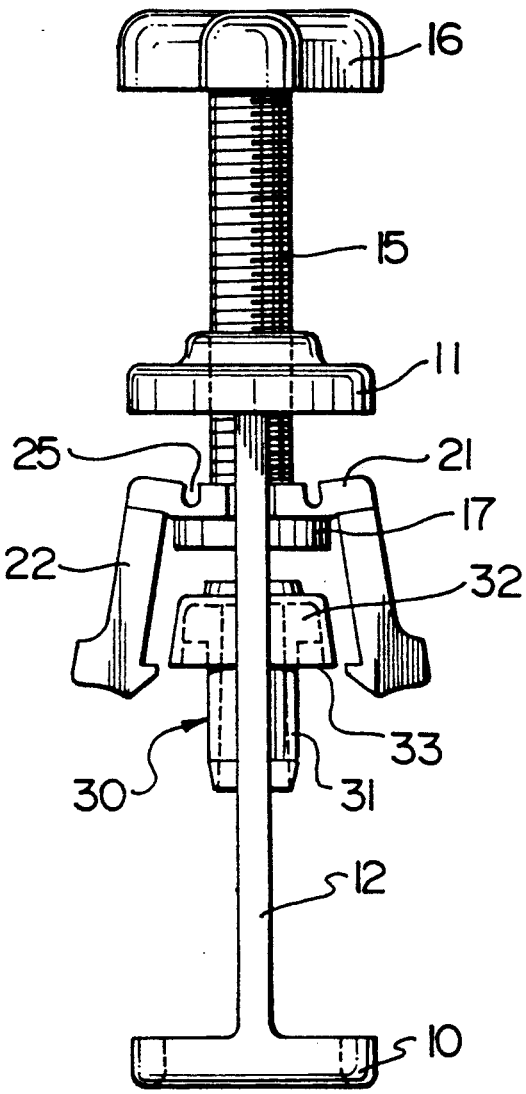
Figure 4:
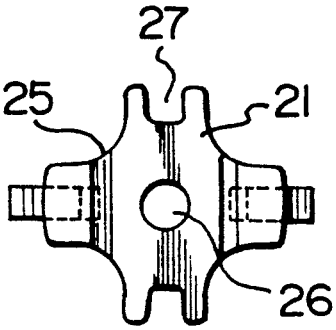
FIG. 4 is a plan view of a gripping unit.

The used stopper 30 is easily removed from the gripper simply by placing one's thumbs in the concave faces 24 of gripper arms 22 and spreading the arms apart so that the stopper falls out. This action is shown in FIG. 3.

Figure 10:
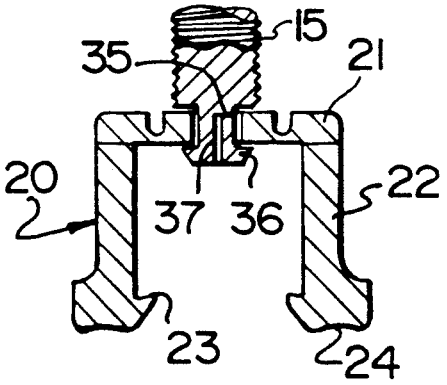
FIG. 10 is a side elevational view in section of an alternative connecting arrangement.

FIG. 10 shows an alternative embodiment for connecting the gripper 20 to the threaded shaft 15. In this arrangement the bottom end of shaft 15 is formed with a cylindrical collar 35 radially inset from the outer diameter of shaft 15. This collar 35 is formed with radial slots 37 and outwardly projecting dogs 36, with the gripper 20 being attached simply by being pushed over the end of collar 35 and being retained against axial movement by the dogs 37.

The stopper pulling device of this invention has several important advantages over the prior art. Most importantly, it is extremely easy to use with the result that it will be used and not be relegated to being another useless gadget. Secondly, it is very simple and easy to manufacture, with the result that it can be sold at a price which can easily be afforded by anyone who can afford a bottle of sparkling wine. Finally, its simple and open design means that it easily fits over a bottle having a wire cage still in place and it is a very simple matter to release the twist wire of a cage between the longitudinal rod member of the frame.

The present invention may be embodied in other specific forms without departing from its spirit or essential attributes. Accordingly, reference should be made to the following claims rather than the foregoing specification, as indicating the scope of the invention.

I claim:

1. A device for removing a mushroom-shaped stopper from a wine bottle, comprising:

(a) a support frame having a bottom ring member adapted to engage the neck of a wine bottle, a top cap member with a threaded hole extending therethrough and at least two circumferentially spaced longitudinal rods extending between the top cap and bottom ring, (b) a threaded shaft having an upper end and a lower end mounted in said top cap threaded hole, this shaft having a handle mounted on the upper end thereof, and (c) a stopper gripping and pulling member comprising a bridge member connected to the lower end of said threaded shaft such that the threaded shaft is free to rotate relative to the bridge member while being fixed against relative axial movement, guideways in said bridge member for receiving said support frame longitudinal rods thereby preventing rotation of said bridge member, a pair of opposed stopper gripping arms extending downwardly from said bridge member, said gripping arms having at the lower ends thereof inwardly extending gripper dogs adapted to slide downwardly over the top of a mushroom-shaped stopper and grip the stopper for pulling and these gripper arms being further adapted to swing outwardly from said bridge member to release a pulled stopper.

2. A device as claimed in claim 1 wherein a disc member is attached to the lower end of said threaded shaft, said disc having an axially upwardly extending collar which is received in a hole in said bridge member, permitting rotation of said shaft relative to the bridge member.

3. A device as claimed in claim 2 wherein the bridge member has grooves or lines of weakness forming self hinges permitting said gripping arms to swing outwardly and release a pulled stopper.

4. A device as claimed in claim 3 wherein the bottom end of each gripping arm includes a concave face portion to permit manual grasping of the arms to release a stopper.

* * * * *